US006864471B2

(12) United States Patent
Mitsumoto et al.

(10) Patent No.: US 6,864,471 B2
(45) Date of Patent: Mar. 8, 2005

(54) COVER FOR AN OPENING IN A HIGH-FREQUENCY HEATING APPARATUS

(75) Inventors: Yoshio Mitsumoto, Kashihara (JP); Takahide Yamaguchi, Kashiba (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/473,383

(22) PCT Filed: Oct. 31, 2002

(86) PCT No.: PCT/JP02/11399

§ 371 (c)(1),
(2), (4) Date: Sep. 25, 2003

(87) PCT Pub. No.: WO03/039200

PCT Pub. Date: May 8, 2003

(65) Prior Publication Data

US 2004/0188431 A1 Sep. 30, 2004

(30) Foreign Application Priority Data

Oct. 31, 2001 (JP) ..... 2001-333999

(51) Int. Cl.[7] ..... H05B 6/74
(52) U.S. Cl. ..... 219/746; 219/756; 333/252
(58) Field of Search ..... 219/746–751, 219/756, 757; 333/252, 227

(56) References Cited

U.S. PATENT DOCUMENTS

| | | | | |
|---|---|---|---|---|
| 3,789,179 A | * | 1/1974 | Haagensen | 219/751 |
| 4,499,356 A | | 2/1985 | Hatagawa | |
| 4,733,037 A | | 3/1988 | Nitta et al. | |
| 5,371,343 A | | 12/1994 | Yoshimura et al. | |
| 6,100,503 A | | 8/2000 | Sasaki et al. | |
| 6,373,037 B1 | | 4/2002 | Brown et al. | |

FOREIGN PATENT DOCUMENTS

| | | | | |
|---|---|---|---|---|
| DE | 1 134 779 | * | 8/1962 | 219/748 |
| EP | 0 848 578 A | | 6/1998 | |
| FR | 1 339 008 A | | 10/1963 | |
| JP | 53-122955 | * | 10/1978 | 219/749 |

* cited by examiner

*Primary Examiner*—Philip H. Leung
(74) *Attorney, Agent, or Firm*—Pearne & Gordon LLP

(57) ABSTRACT

A plurality of slots are provided so as to be located between a thin plate flexible opening section screen member and a heating chamber wall surface 1 for allowing insertion of the opening section screen member. A gently-curved bulging surface exists in an area where the heating chamber wall surface 1 and the opening section screen member 5 are mated together. As a result, residual warpage which would otherwise remain when the opening section screen member is warped for attachment becomes invisible, thereby preventing occurrence of clearance, which would cause sparking or the like.

6 Claims, 4 Drawing Sheets

PRIOR ART FIG. 6
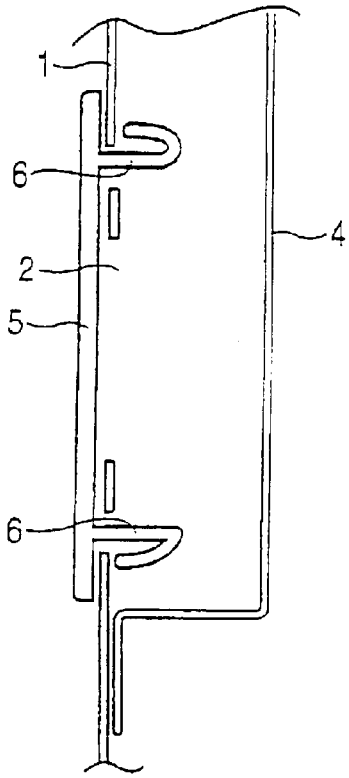
PRIOR ART FIG. 7
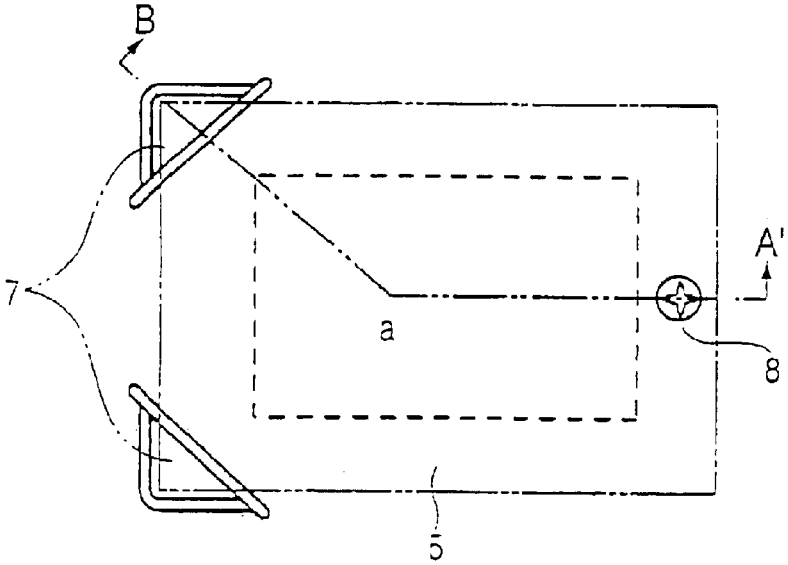

A-a-A'

COVER FOR AN OPENING IN A HIGH-FREQUENCY HEATING APPARATUS

This application claims the benefit of International Application Number PCT/JP02/11399, which was published in English on May 8, 2003.

TECHNICAL FIELD

The invention relates to a high-frequency heating device which has achieved an improvement in simplification, ease of attachment, durability, and appearance of a screen body disposed at an opening section of a heating chamber.

BACKGROUND OF THE ART

A screen member disposed at an opening section of a high-frequency heating apparatus has hitherto been roughly classified into the following two types. Namely, one type of screen member is employed in a heating apparatus having a heater to be used for heating the internal space of a heating chamber. A laminated mica plate, which is thermally stable, is hooked on a slot provided on a wall surface of the heating chamber and secured with engagement members, such as screws. Another type of screen member is a resin-made opening section screen member often seen in a single-function type of heating apparatus which does not have any heater. The screen member is attached to a wall surface of the heating chamber by utilization of elasticity (spring characteristic) of an attachment engagement section. Engagement members, such as screws, are not usually required. Adoption of the screen member of former type for a heating apparatus of single-function type has recently become mainstream, with an aim toward curtailing costs of material and molds.

In FIG. 5, reference numeral 1 designates a heating chamber, and an opening section 2 which is to act as a high-frequency radiation inlet port is provided in a right-side side wall of the heating chamber 1. Reference numeral 3 designates a magnetron which is to serve as high-frequency radiation generation means. The magnetron 3 is attached to one end of a waveguide 4 for guiding high-frequency radiation generated in the heating chamber 1. The opening section 2 is provided in the vicinity of the other end of the waveguide 4 and covered with an opening section screen body 5. If the opening section screen body 5 is not provided, lamp black or waste which would arise from food during the course of cooking will attach to the inside or end face of the opening section 2. As a result, concentration of an electric field would develop in the waveguide 4, which has a high electric field, thereby causing burning or sparking. This results in serious failures, such as smoking, inflammation, or leakage of radio waves.

FIG. 6 shows that the opening section screen member 5 is attached to a wall surface of the heating chamber by means of a flexible plastic attachment engagement section 6 and without use of screws for engagement purpose.

As shown in FIG. 7, the opening section screen member 5 is a substantially rectangular laminated mica plate having a thickness of about 0.2 to 1 mm. In the embodiment, two of four corners of the opening section screen member 5 are inserted into slots 7 provided in the wall of the heating chamber. One area of the opening section screen member 5 is fixedly attached to the wall surface of the heating chamber by means of a screw member 8 formed in the shape of a screw or clip.

FIG. 8 is a cross-sectional view of the opening section screen member 5 taken along line A-a-A' line shown in FIG. 7. The left end of the opening section screen member 5 is inserted into the slots 7, and the right end of the same is secured with the engagement member 8.

The example has described a rectangular opening section screen member having four corners. However, in the case of a triangular opening section screen member, two or one area may be fastened, and another one area may be fixed. Alternatively, even in the case of a rectangular opening section screen member, one or three areas may be fastened, and another area may be fixed with use of an engagement member.

FIG. 6 is a configuration into which the configuration described by reference to FIG. 7 has been further rationalized. The periphery of the thin-plate, substantially rectangular opening section screen member 5 consisting of a laminated mica plate is engaged with the slots 7 formed in the wall surface of the heating chamber. No engagement members having the shape of screw or clip are used.

The opening section screen member 5 consisting of a laminated mica plate is as thin as 1 mm or less and hence has flexibility in a thickness wise direction thereof. At this time, the opening section screen member 5 has a dimension of L mm in a longitudinal direction thereof. The drawing can be utilized as a plan view of a first embodiment of the invention, which will be described later.

The related-art configuration enables reduction of engagement members, such as screws. However, warpage which would arise when the laminated mica plate is deflected remains, thereby causing slight clearance between the laminated mica plate and the wall surface of the heating chamber. FIG. 3 is a slightly exaggerated view of the clearance. Although the clearance is nominal, a substantial center of the length of the laminated mica plate attains maximum deflection with reference to the wall of the heating chamber, which is a plane surface. Hence, the clearance becomes very noticeable in terms of appearance. That clearance is prone to accumulation of oil black originating from food or food waste splashed from food, thereby causing smoke or inflammation. Moreover, when a user cleans the heating apparatus, the clearance may become a factor for prompting the user to remove the mica plate during the course of cleaning.

DISCLOSURE OF INVENTION

The invention aims at solving the problem of the related-art configuration and providing a high-frequency heating apparatus which enables tight fitting of an opening section screen member to a wall surface of a heating chamber without involvement of occurrence of clearance in spite of the fact that the opening section screen member is an inexpensive laminated mica plate and attachment of the opening section screen member does not involve use of screws or clips.

To solve the problem of the related art, at least a part of a mating surface at where the opening section and the opening screen member are mated together is curved toward inside of the heating chamber. Even when warpage still remains, caused by deflecting the opening section screen member when the opening section screen member is attached to slots of the wall of the heating member, the wall surface of the heating chamber is curved in the same manner and in the same direction. Hence, clearance is less likely to arise even after the screen member has been attached to the wall surface.

The invention defined in claim 1 enables a curved surface portion of a heating chamber wall surface to tightly mate with an opening section screen member even when the screen member is warped, by means of an area where an opening section and an opening section screen member are mated together to become curved toward the inside of a heating chamber.

According to the invention defined in claims 2 through 5, even when a plurality of opening sections exist or when the material of the opening section screen member is changed to resin or a thin glass plate, the same advantage can be expected to be yielded.

BRIEF DESCRIPTION OF DRAWINGS

FIG. 6 is a block diagram showing a related-art opening section screen member formed by resin molding;

FIG. 7 is a block diagram showing an attached state of an opening section screen member using a related-art thin plate.

BEST MODE FOR CARRYING OUT THE INVENTION

An embodiment of the invention will be described hereinbelow by reference to the drawings.

Figure 1:
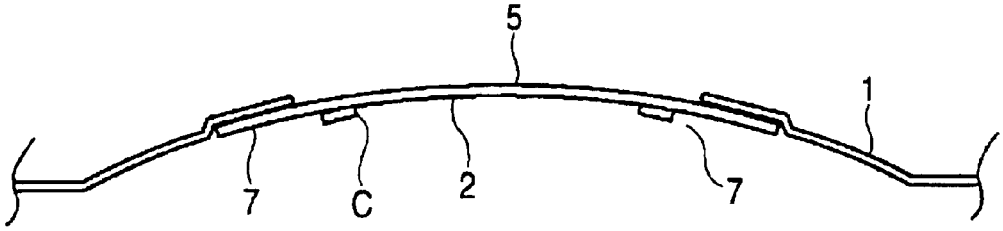
FIG. 1 is a cross-sectional view of a wall surface of a heating chamber according to an embodiment of the invention.

FIG. 1 is a view showing a high-frequency heating apparatus according to an embodiment of the invention.

Figure 2:
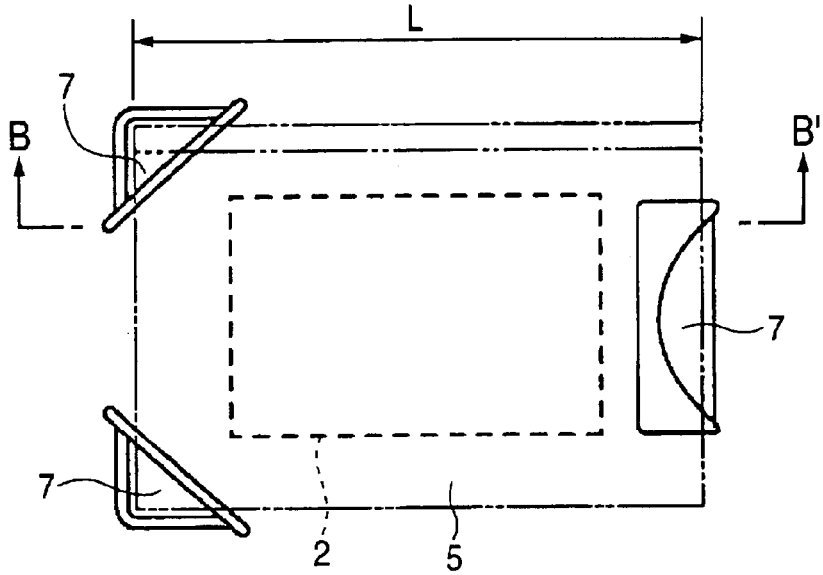
FIG. 2 is a block diagram showing that a thin plate opening section screen member according to the embodiment of the invention is attached to the wall surface.

In FIG. 1, a heating chamber wall surface 1 is provided with an opening section 2 which serves as an entrance of a high-frequency chamber. Both sides of an opening section screen member 5 which possesses flexibility and consists of a thin laminated mica plate are inserted into a plurality of slots 7 provided in the heating chamber wall surface 1. FIG. 2 is a view of the opening-section screen member 5 when viewed from the top.

The heating chamber wall surface 1 of the invention is formed so as to assume a diameter C which constitutes a gentle curved surface. Specifically, even if the curvature differs from one location to another, an advantage is still yielded, so long as the curvature is continuous.

The curvature will be described by reference to FIGS. 2 and 3. The opening section screen member 5 which has a dimension L in a flat state is inserted into the slots 7 while being elastically deformed so as to become smaller than a dimension L' defined between the slots 7 of the heating chamber 1. The dimension C of the wall surface of the heating chamber shown in FIG. 1 is set so as to assume a diameter greater than the curvature of the opening section screen member 5 when it is elastically deformed. As a result, even after the opening section screen member 5 has been attached, the heating chamber wall surface 1 and the opening section screen member 5 can be brought into tight contact with each other without involvement of occurrence of clearance.

The Embodiment has described a case where the opening section of the heating chamber is provided in the side surface thereof. However, the same advantage is yielded even when the opening section is formed in an upper surface or bottom surface of the heating chamber.

A required advantage is yielded by making a determination as to whether or not the curved surface provided in the heating chamber constitutes the entirety or a portion of a mating surface existing between the wall surface of the heating chamber and the opening section screen member, on the basis of the position and geometry of the curved surface.

The same advantage can be readily yielded even when a thin plastic or glass plate, including a laminated mica plate, is used for the opening-section screen member, as described in the embodiment.

Figure 3:
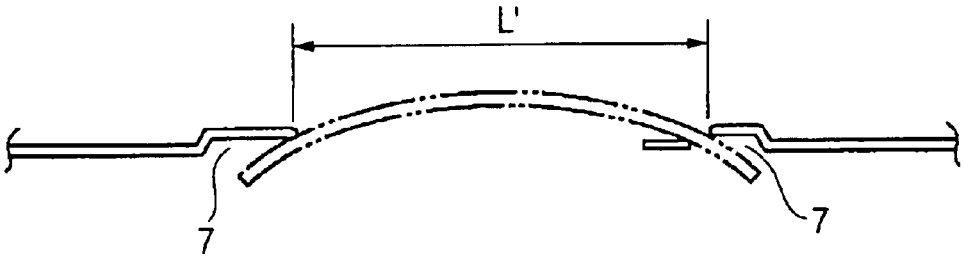
FIG. 3 is a view showing warpage still remaining in the opening section screen member, wherein the warpage has arisen when the thin plate opening section screen member of the embodiment of the invention is attached to the wall surface of the heating chamber.

FIG. 3 shows a dimensional relationship between the interval existing between the slots 7 and the opening section screen member 5 formed from a laminated mica plate.

At the time of attachment, the opening section screen member 5 is deflected so as to become smaller than the dimension L' between the slots. Such a configuration obviates a necessity for fastening the screen member 5 with screws.

Figure 4:
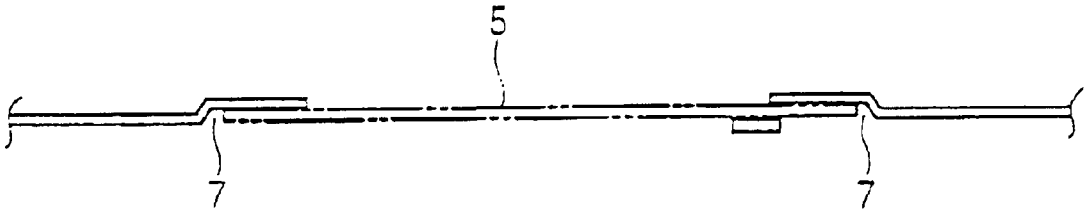
FIG. 4 is a view showing that the thin plate opening section screen member of the embodiment of the invention is attached to the wall surface while remaining in a flat state.
Figure 5:
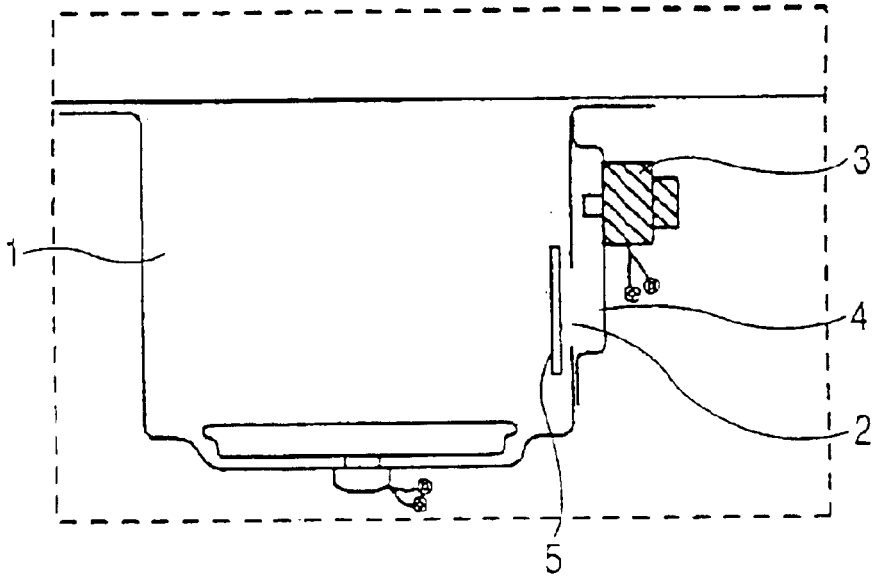
PRIOR ART FIG. 5
FIG. 5 is a block diagram showing a related-art high-frequency heating apparatus.
Figure 8:
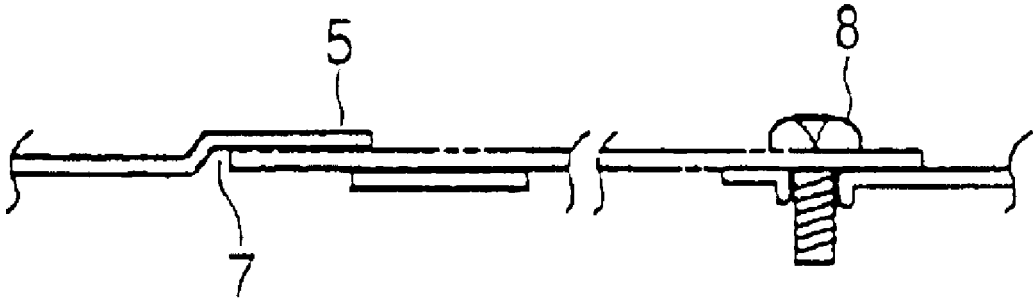
PRIOR ART FIG. 8
FIG. 8 is a cross-sectional view of the opening section screen member that uses a related-art thin plate and is shown in FIG. 7, showing an attached state thereof.

FIG. 4 shows that both ends of the opening section screen member 5 are fitted into the corresponding slots 7 and restored completely to their original geometries and dimensions.

The thin plate opening section screen member is attached by utilization of elastic restoration force of a material of the screen member, thereby obviating a necessity for fastening members, such as screws or clips. The material of the opening section screen member has a low unit price, and the screen member can be attached to the heating apparatus without use of tools. Thus, the opening section screen member can be realized by means of a considerably simple construction.

There is prevented occurrence of clearance, which would otherwise arise between the wall surface of the heating chamber and a thin plate opening section screen member for reasons of insufficient restoration of the screen member. Accordingly, there are prevented staining of the pieces of clearance which would otherwise be caused by food wastes splashed from food, the food being an object of heating, or by long-term usage, as well as sparking or inflammation due to concentration of an electric field, which would be likely to arise in an intensive electric field of high frequency. A resultant heating apparatus is superior in quality or durability.

As mentioned above, the clearance is small and not unsightly. The screen member can be constructed sturdily without involvement of a worry about damage, which would otherwise be imposed when cloth is caught by the screen during the course of cleaning or wiping. In the majority of high-frequency heating apparatus of single-function type which do not have a so-called thermostat function attributable to a heater, a heating chamber assumes comparatively low heat resistance, a bright color, and the impression of cleanliness. Since clearance existing between a wall surface and the opening section screen member appears dark, the clearance is very conspicuous and obtrusive.

When the opening section screen member is to be removed by necessity, removal operation does not involve a necessity of screws, clips, or special tools and hence is easy. Since attachment of the opening section screen member is easy, the reliability of the screen member is correspondingly superior.

An opening section screen member formed from a thin plate does not need an expensive, complicated metal mold, which would be required in the case of a resin-molded opening section screen member. The opening section screen member can be provided inexpensively and within a short period of time.

Industrial Applicability

As has been described, according to the inventions of claims 1 through 4, the thin plate opening section screen member is attached by utilization of elastic restoration force of a material of the screen member, thereby obviating a necessity for fastening members, such as screws or clips. The material of the opening section screen member has a low unit price, and the screen member can be attached to the heating apparatus without use of tools. Thus, the opening section screen member can be realized by means of a considerably simple construction. Further, there is prevented occurrence of clearance, which would otherwise arise between the wall surface of the heating chamber and a thin plate opening section screen member for reasons of insufficient restoration of the screen member. Accordingly, there are prevented staining of the pieces of clearance which would be caused by food wastes splashed from food, the food being an object of heating, or by long-term usage and sparking or inflammation due to concentration of an electric field, the concentration being likely to arise in an intensive electric field of high frequency. A resultant heating apparatus is superior in quality or durability.

What is claimed is:

1. A high-frequency heating apparatus comprising:

a heating chamber for heating an object of heating;

high-frequency radiation generation means;

an opening section which is formed in a wall surface of the heating chamber and acts as an entrance for high-frequency radiation; and an opening screen member for covering the opening section, wherein at least a part of a mating surface at where the opening section and the opening screen member are mated together is curved toward inside of the heating chamber a curved surface which is provided at a position where the opening section and the opening screen member are to be mated together and assumes a protrusion toward the inside of the heating chamber.

2. The high-frequency heating apparatus according to claim 1, wherein all of the mating surface is curved toward inside of the heating chamber.

3. The high-frequency heating apparatus according to claim 2, wherein the heating apparatus comprises a plurality of opening sections.

4. The high-frequency heating apparatus according to claim 1, wherein the heating apparatus comprises a plurality of opening sections.

5. The high-frequency heating apparatus according to any of claim 1 to 4 or 3, wherein the opening screen member involves little loss of high frequency radiation and is formed from a flexible laminated mica plate.

6. The high-frequency heating apparatus according to any of claim 1 to 4 or 3, wherein the opening screen member involves little loss of high frequency radiation and is formed from a flexible thin glass plate or thin plastic plate.

* * * * *